US006745948B1

(12) United States Patent
Hidaka et al.

(10) Patent No.: US 6,745,948 B1
(45) Date of Patent: Jun. 8, 2004

(54) METHOD AND DEVICE FOR SPIRAL SPRAY COATING

(75) Inventors: Shoji Hidaka, Osaka (JP); Seiki Tarumi, Osaka (JP)

(73) Assignee: Kabushiki Kaisha Santuuru, Osaka (JP)

( * ) Notice: Subject to any disclaimer, the term of this patent is extended or adjusted under 35 U.S.C. 154(b) by 0 days.

(21) Appl. No.: 09/890,380

(22) PCT Filed: Mar. 27, 2000

(86) PCT No.: PCT/JP00/01853

§ 371 (c)(1),
(2), (4) Date: Jul. 27, 2001

(87) PCT Pub. No.: WO00/58017

PCT Pub. Date: Oct. 5, 2000

(30) Foreign Application Priority Data

Mar. 29, 1999 (JP) ..... 11-124624

(51) Int. Cl.[7] ..... A62C 5/02

(52) U.S. Cl. ..... 239/8; 239/291; 239/292; 239/296; 239/424

(58) Field of Search ..... 239/291, 292, 239/296, 298, 418, 423, 424, 424.5, 8

(56) References Cited

U.S. PATENT DOCUMENTS 4,171,096 A * 10/1979 Welsh et al. ..... 239/291
4,969,602 A * 11/1990 Scholl ..... 239/298
5,102,484 A * 4/1992 Allen et al. ..... 239/298
5,964,418 A * 10/1999 Scarpa et al. ..... 239/424
6,149,076 A * 11/2000 Riney ..... 239/424.5

FOREIGN PATENT DOCUMENTS

| | | |
|---|---|---|
| JP | 3-146160 | 6/1991 |
| JP | 3047146 | 3/1998 |
| JP | 3048747 | 5/1998 |

* cited by examiner

*Primary Examiner*—Dinh Q. Nguyen
(74) *Attorney, Agent, or Firm*—Koda & Androlia

(57) ABSTRACT

A spiral spray coating method, comprising the step of forming a second pressurizing air flow which is discharged from a number of second pressurizing air holes (13) positioned concentrically with and outwardly-shaped from first pressurizing air holes (12), on the outside of the first pressurizing air flow which is discharged from a number of first pressurizing air holes (12) disposed concentrically with an opening of an adhesive agent hole (11) so as to feed the second pressurizing air flow (K2) to the outside of the first pressurizing air flow (K1) in order to form an air curtain of the second pressurizing air flow on the outside of a spiral of a hot-melt adhesive agent fiber; a spiral spray coating apparatus using the spiral spray coating method.

5 Claims, 11 Drawing Sheets

METHOD AND DEVICE FOR SPIRAL SPRAY COATING

TECHNICAL FIELDS

This invention relates to a method and apparatus for spiral spray coating and has for its object to widen the coating width by forming a spiral spray coating pattern by the process of causing a rotating spray flow of pressurized air (rotating air jet centering an adhesive hole in plan view) to act on hot melt adhesive bead extruded form the center of a nozzle tip.

BACKGROUND ART

As to the method of spiral spray coating and apparatus therefore, Tokukaisho No. 61-200869 (Method and apparatus for spraying a molten adhesive agent) has been well known. This laid-open patent specification discloses the coating art whereby the width of coating on material is enlarged by coating in a spiral spray pattern which is obtained by causing a rotating jet of pressurized air to act on a hot melt adhesive bead being extruded form an adhesive hole of a nozzle.

In the above prior art, however, in the case where viscosity of hot melt adhesive agent to be fed is high, rotation of a spiral spray pattern lowers extremely due to high viscosity of heated and molten hot melt adhesive agent extruded from an adhesive hole of a nozzle apparatus and consequently a filamentous spiral pattern as shown by H0 in FIG. 17, instead of a spiral rotating pattern, is formed.

Thus, a spiral spray pattern coating cannot be expected. Moreover, as shown in FIG. 18, a grain p (also referred to a shot, a hook or the like) is formed at the start of spray coating. This grain p settles on the coating surface of a material (film, for instance) and makes a hole in the material by melting. Thus, merchandize value is lowered. In the case of intermittently repeated coating, this grain p is dispersed at each spraying and soils a coating line and a coating workshop.

Furthermore, referring to FIG. 18, problem is that in spiral spray coating by the spiral spray coating apparatus, accompanying air Ka occurs outside the pressurized air flow (spiral air) K1. This accompanying air Ka amounted to more than 10 time more than the pressurized air flow (spiral air) K1, with the result that oil parts and low molecule parts of a hot melt adhesive cling to and around a top end of a nozzle tip in the shape of micro-sized fiber. Thus, paper dust in the workshop cling to and around a nozzle hole and collects there. As a result, such troubles as the loss of working time caused by replacement of a clogged nozzle and manufacturing of inferior products (due to collected paper dust falling on and mixing in material) are inevitable.

Regarding a spiral spray coating method and an apparatus therefore, Tokukaihei No. 3–146160 (Method and apparatus for hot melt adhesive coating) is also well known. This laid-open patent specification discloses a spray pattern coating by causing rotating spray (whirling flow) of pressurized air to act a hot melt adhesive being extruded from an adhesive hole of a nozzle, similar to the above-mentioned Tokukaisho No. 61–2000869 and also the present invention. This patent specification discloses formation of a non-conical spiral pattern (an elliptical pattern) and a pattern of small and large elliptical shapes connecting alternately by blowing air against a spiral bead from the side direction. Although this apparatus has the second compressed air holes, it does not settle the problems of dispersing particles p and accompanying air Ka.

Both Utility Model Official Gazette No. 30470146 (Coating gun apparatus) and No. 3048747 (Coating gun apparatus) disclose the second air flow which is formed by means of a hood surrounding a jet nozzle body and compressed air exhausting holes made at the circumferential part of said hood. According to this gun apparatus, open air flowing-in holes are made in horizontal direction against a spray nozzle body so that the open air from the open air flowing-in holes is caused to act on coating liquid from the spray nozzle body, whereby coating liquid is dispersed in the shape of microsized particle while it is regulated in the coating direction and coating scope by the hood. Therefore, this apparatus does not relate to the spiral spray coating by forming a spiral splay coating pattern by the process of causing a rotating spray flow of pressured air (rotating air jet centering an adhesive hole in plan view) to act on hot melt adhesive bead extruded from the center of a nozzle hole, which is the object of the present invention. It is true that this apparatus has the effect of limiting the coating range by forming an air curtain by pressurized air (the second air flow) extruded from the circumferential part of the hood but does not settle the problems of dispersing particles p and accompanying air Ka. Because it is free from the problems of dispersing particles p and accompanying air Ka shown in FIG. 18 due to non-existence of the composition of a horizontal bottom surface of the nozzle tip. Further, this apparatus does not have the action and effect of obtaining a regular coating width and a well-formed spiral spray coating pattern by coursing an auxiliary pressured air flow from plural second pressurized air holes to act on a spiral coating pattern rotating at high speed.

DISCLOSURE OF INVENTION

An object of the present invention is to provide a method and an apparatus for spiral spray coating, whereby even high viscosity hot melt adhesive and resin are available for coating in a spiral spray pattern of high-speed rotation and also a regular coating width and a regular spiral spray pattern can be obtained.

Another object of the present invention is to make the particle p as small as possible and confine the setting point of particles p within the range of a spiral rotating pattern.

Still another object of the present invention is to prevent occurrence of accompanying air in spiral spray coating.

The first invention of the present application provides that, in the method of spiral spray coating, whereby a spiral spray pattern is formed by causing a rotating jet of pressurized air extruded form a plurality of pressurized air holes disposed circularly in close proximity to an adhesive hole at the bottom side of a nozzle tip to act on a hot melt adhesive bead being extruded from an adhesive hole opening at a projecting part at the center of the bottom side of the nozzle tip, a method for spiral spray coating characterized in that it comprised by forming the second pressurized air flow, which is extruded from many second pressurized air holes located concentrically around the first pressurized air holes, at the outside of the first pressurized air flow which is extruded from many first many first pressurized air located concentrically around an opening of an adhesive hole, by forming a circular air curtain concentric with the center of a spiral by the second pressurized air flow K2 which is fed to the outside of the first pressurized air flow (spiral air).

The second invention of the present application is characterized in that, in the first invention, the second pressurized air flow K2 is supplied independently of the first pressurized air flow K1.

BEST MODE FOR CARRYING OUT THE INVENTION

The present invention will be described below, with reference to be accompanying drawings.

Figure 5:
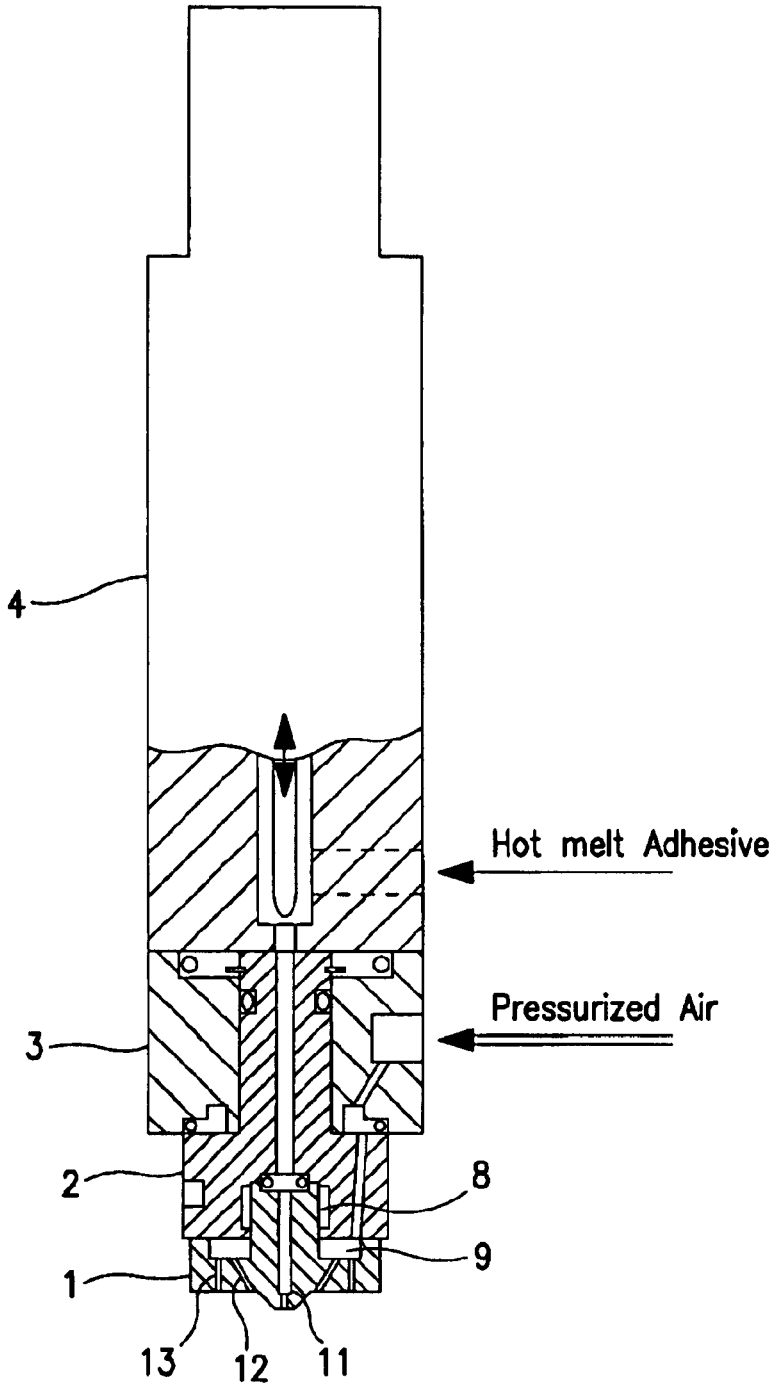
FIG. 5 is a front view, showing the gun unit of the spiral spray coating apparatus in fragmentary cross-section.

FIG. 5 shows a gun unit of a spiral spray coating apparatus, comprising a hot melt supply control valve 4, a gun base 3, a nozzle body 2 and a nozzle tip.

Figure 1:
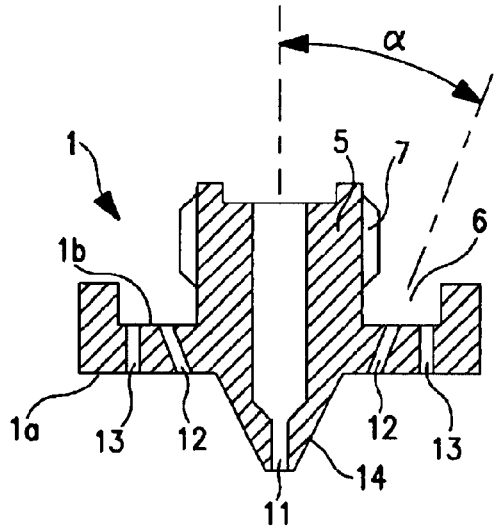
FIG. 1 is a longitudinal cross-section of the nozzle tip of the first invention of the present Application.
Figure 2:
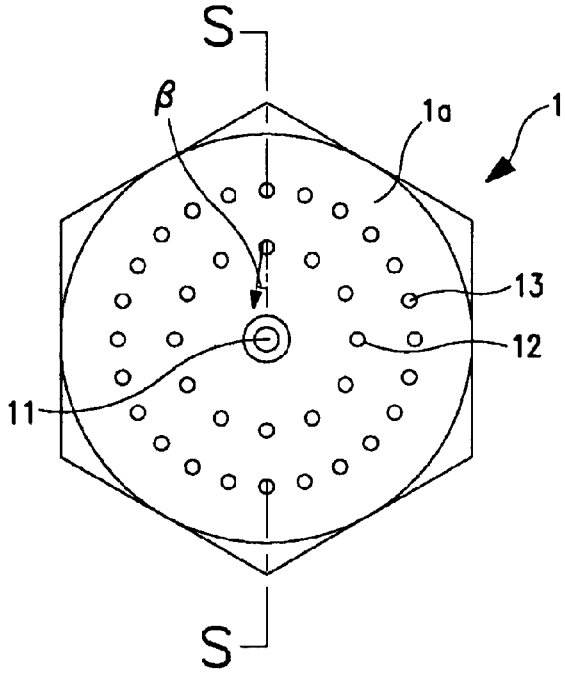
FIG. 2 is a plan view of the nozzle tip which a boss part is omitted.
Figure 3:
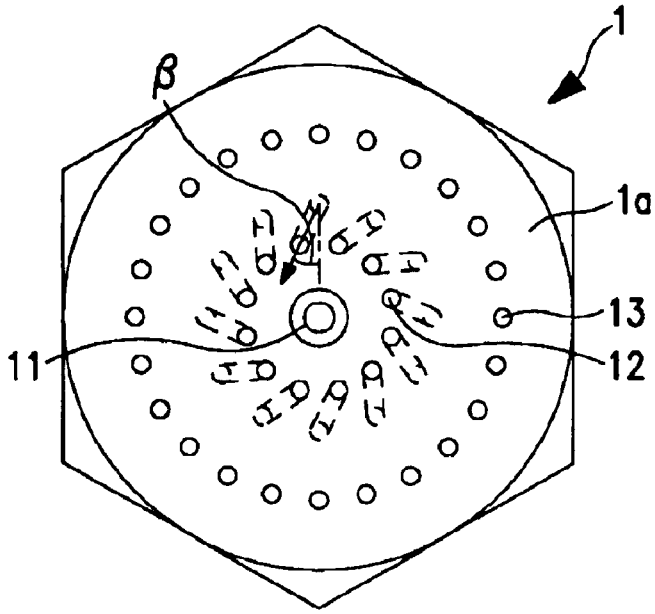
FIG. 3 is an explanation drawing, showing the location of the adhesive hole, the pressurized air hole and second pressurized air hole at the bottom side of the nozzle tip.

In order to exploitation of the first invention of the present application, the nozzle tip 1 will be explained below, with reference to FIG. 1–FIG. 3.

The nozzle tip 1 has an adhesive hole 11 at the center thereof and a plurality of pressurized air hole 12 are disposed concentrically with said adhesive hole 11. The plurality of pressurized air holes 12 are disposed at the angle of inclination $\alpha$ and at the angle of rotation (eccentric angle) $\beta$ in relation to the nozzle tip 1. An inverted truncated projection 14 is connected to the central part of the bottom side of the nozzle tip 1. An adhesive hole 11 open at a lower end of the truncated projection 14 (or at the top end of the projection). The bottom side of the nozzle tip 1 is formed horizontally (excepting the truncated projection 14).

The plurality of pressurized air hole 12 are disposed near the upper end of the truncated projection 14 (close to the projection part of the bottom side) and open at the bottom side 1*a* of the nozzle tip 1. Form at the upper side 1*b* of the nozzle tip 1 is a boss part 5 surrounding the adhesive hole 11. A concaved part 6 is formed around said boss part 5. The boss part 5 is threaded 7 and is united with the nozzle body 2 through the medium of a screw fit structure 8 (refer to FIG. 5). A pressurized air chamber 9 is formed the concaved part 6 and the underside of the nozzle body.

A plurality of the second pressurized air hole 13 are formed in early perpendicular direction (in diametrical longitudinal section of the nozzle tip 1) at the outer circumferential part of the upper side 1*b* of the nozzle tip 1.

Figure 4:
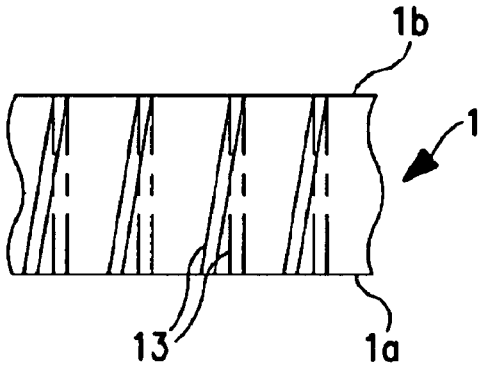
FIG. 4 is a cross section at S—S, line in FIG. 2 (connection circle showing the disposition of the second pressurized air hole).

The second pressurized air holes 13 are slanted in concentric direction in which they are disposed, namely, openings of the second pressurized air holes 13 at the bottom side la incline in such a fashion that they precede in concentric direction in which the second pressurized air holes 13 are disposed (Refer to FIG. 4).

Figure 6:
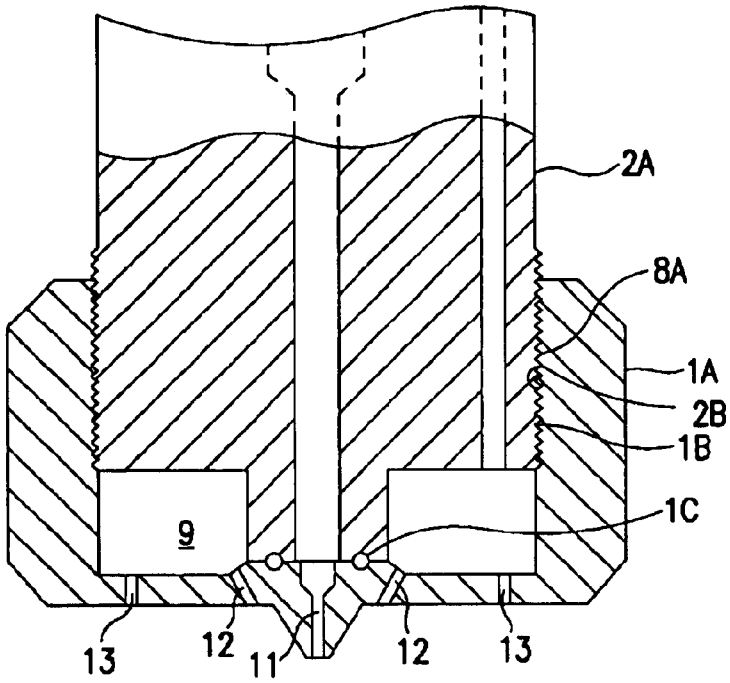
FIG. 6 is a longitudinal section of the nozzle tip of the second embodiment of first invention of the present Application.
Figure 7:
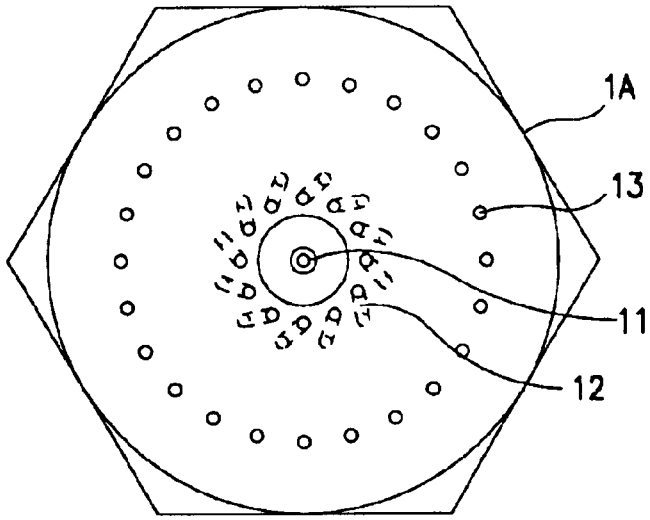
FIG. 7 is an explanatory drawing, showing the location of the adhesive hole, the pressurized air hole and second pressurized air hole at the bottom (in FIG. 6), similar to FIG. 3.
Figure 8:
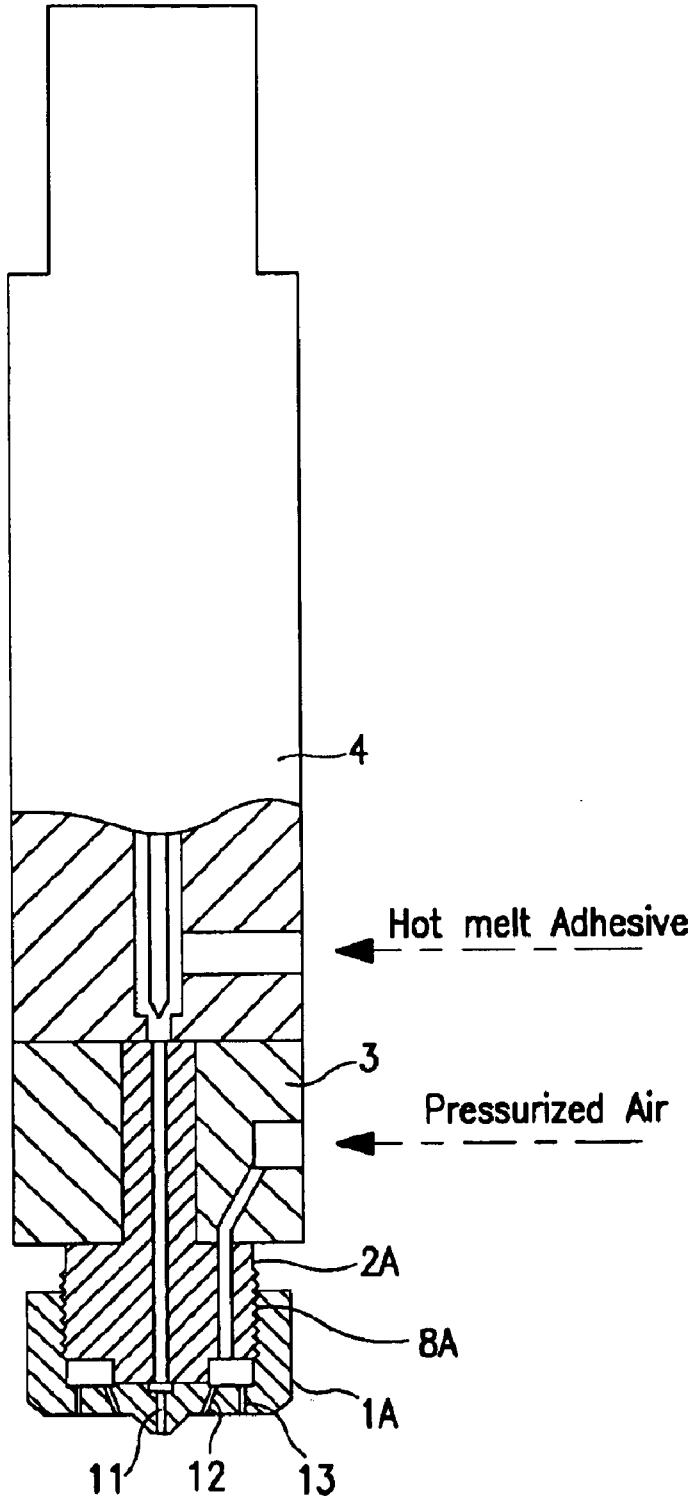
FIG. 8 is a front view, showing the gun unit in fragmentary cross-section (in FIG. 6), similar to FIG. 5.

FIG. 6–FIG. 8 show connecting the nozzle tip 1A and the nozzle body 2A, a screw fit structure 8A is adopted. This screw fit structure 8A is formed between the inner surface of a cylindrical body 1B extended form the nozzle tip 1A and projecting part 2B of the nozzle body. In FIG. 6, 1C designates a sealing member which interrupts between the adhesive passage and the pressurized air passage.

Figure 9:
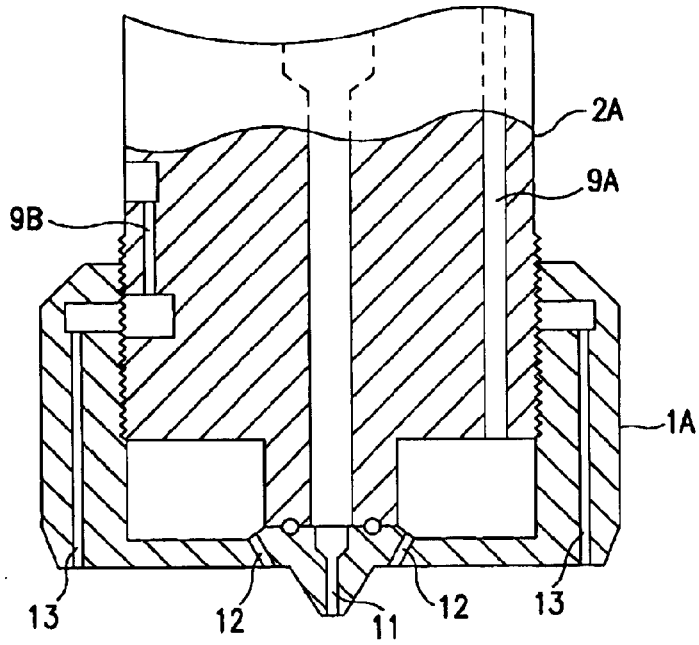
FIG. 9 is a longitudinal cross section of the nozzle tip of the embodiment of the second invention of the present application.
Figure 10:
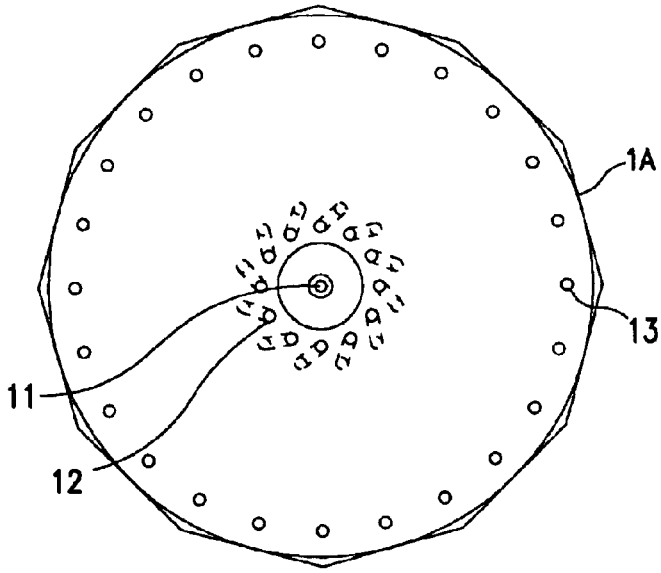
FIG. 10 is an explanatory drawing, showing the location of the adhesive hole, the pressurized air hole and second pressurized air hole at the bottom (in FIG. 9), similar to FIG. 3.
Figure 11:
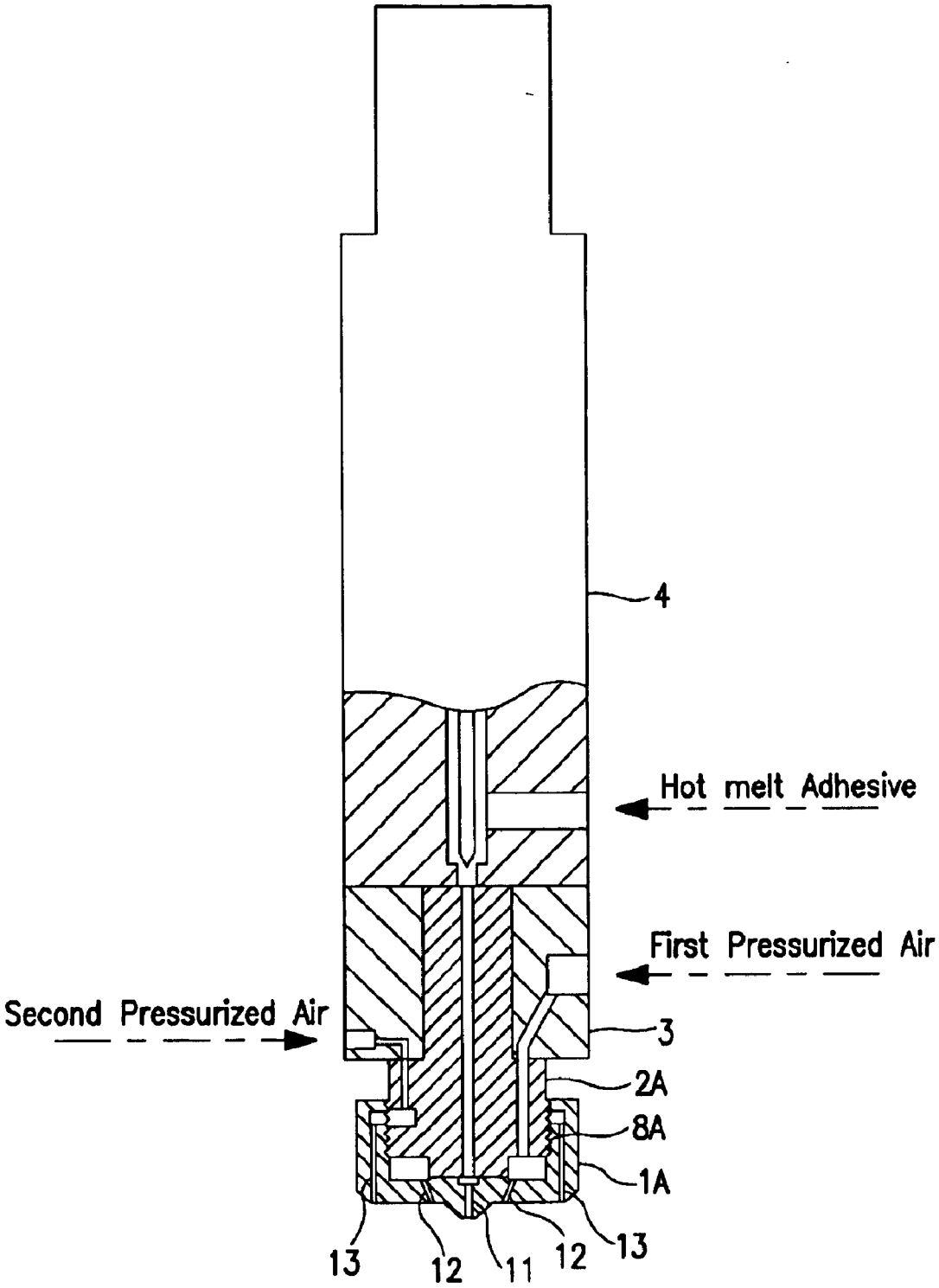
FIG. 11 is a front view, showing the gun unit in fragmentary cross-section (in FIG. 9), similar to FIG. 5.
Figure 12:
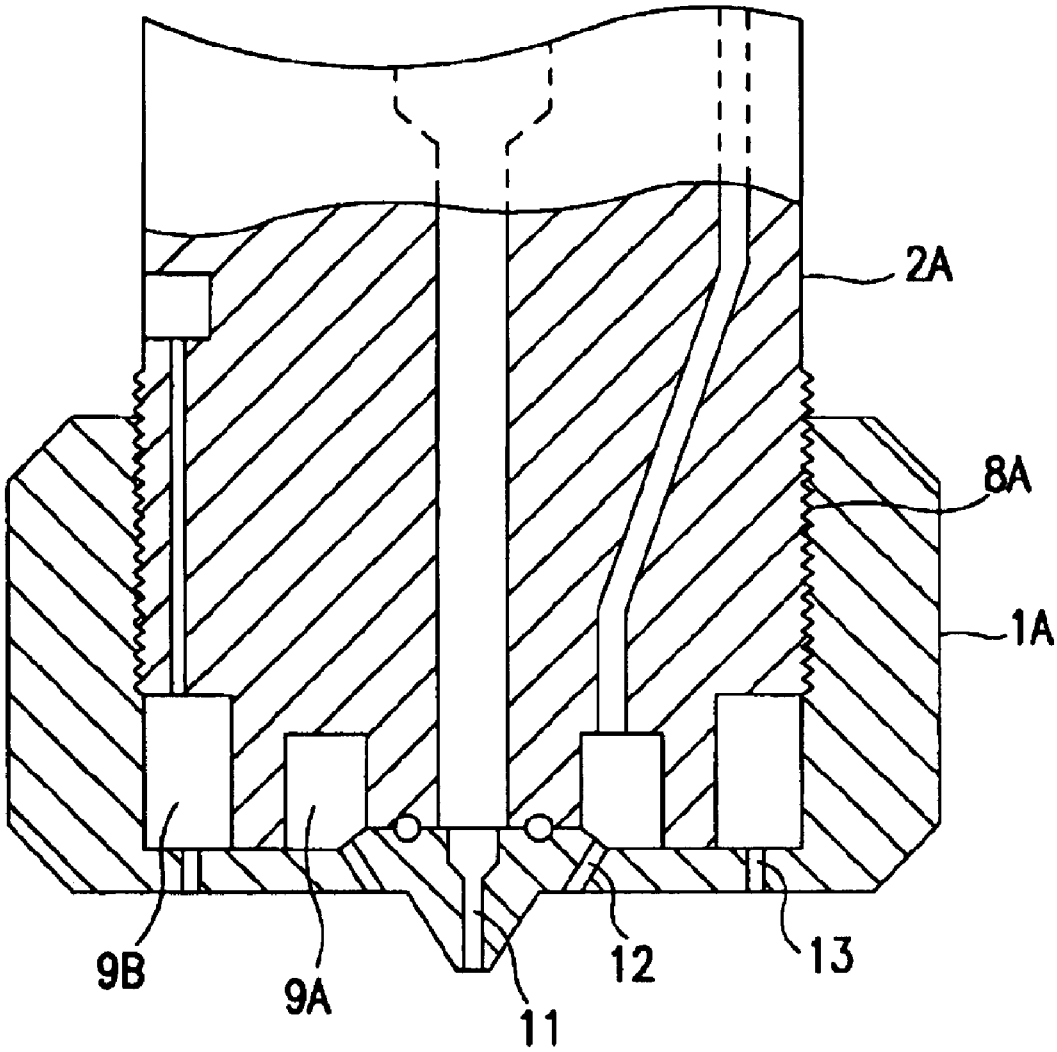
FIG. 12 is a longitudinal cross section of the nozzle tip of the second embodiment of the forth invention of the present application.

FIG. 9–FIG. 11 show an embodiment of the fourth invention of the present application. It is characterized in that the second pressurized air passage 9B in relation to the second pressurized air hole 13 is composed independent of the first pressurized air passage 9A in relation to the first pressurized air hole 12. The fourth invention of the present application can also be effected by dividing the pressurized air chamber 9 (shown in FIG. 12) into the second pressurized air passage 9B at the outer circumferential side and the first pressurized air passage 9A close to the center (refer to FIG. 12).

Figure 13:
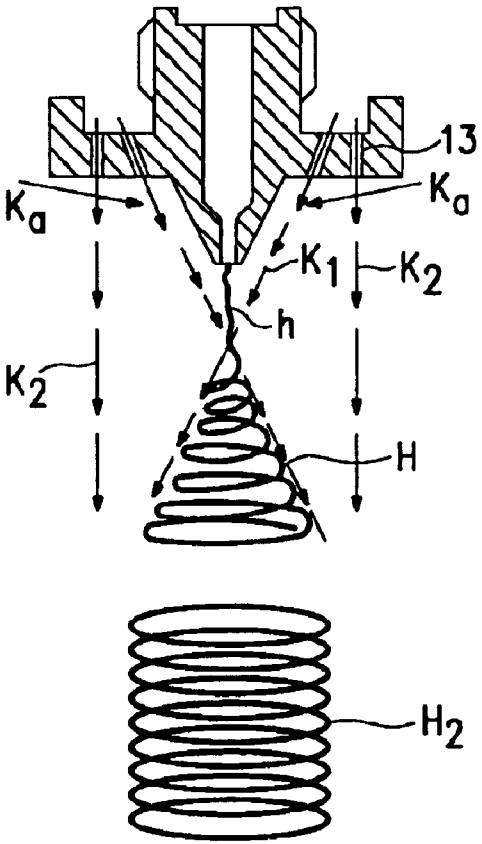
FIG. 13 is an explanatory drawing, showing the action of the auxiliary air flow from the second pressurized air hole in the first invention of the present Application.

Refer to FIG. 13, the spray coating action according to the first invention of the present application is explain below.

It is similar to the hot melt adhesive coating apparatus of prior art that a material (work, for instance, polyester on the seat) is set on the adhesive coating line and is conveyed by one way, and the hot melt adhesive from the nozzle tip of gun unite mounted upper the adhesive coating line is sprayed for the material being conveyed on the surface of the adhesive coating line, whereby the hot melt adhesive being coated to the appointed potion on the material.

In the spiral spray coating apparatus of the present invention, filamentous hot melt adhesive from the adhesive hole 11 of the nozzle tip 1 of the gun unit is whirled and elongated into spiral sharp by the action of the first pressurized air flow K1 (whirling pressurized air flow) based on a pressurized air flow discharged from a plurality of pressurized air holes 12 and thus a spirally rotating pattern H1 of adhesive fiber is formed and is sprayed on a coating surface. At this time, the second pressurized air flow (auxiliary pressurized air flow) K2 from the second pressurized air holes 13 falls perpendicularly in circular sharp as it is surrounding the spirally rotating pattern H1 of adhesive fiber.

Figure 17:
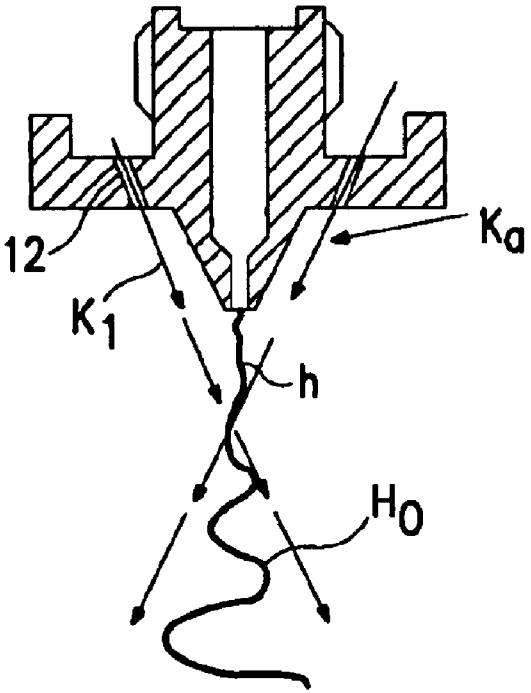
FIG. 17 is an explanatory diagram, corresponding to the action in the prior art shown by FIG. 14.

In the case where high viscosity hot melt adhesive is coated, without the auxiliary pressurized air flow K, a rotating pattern h of filamentous melt adhesive is not formed (as shown by H0 in FIG. 17). However, even high viscosity hot melt adhesive is formed into a spiral rotation pattern H1 (FIG. 14) by an auxiliary air flow of cylindrical pattern formed by the second air flow K2 (auxiliary pressurized air flow) extruded from the second pressurized air hole 13.

Moreover, since the spiral rotating pattern H1 rotates at high velocity, adhesive is coated in the state of multiple oval H2, as shown in FIG. 13, and minute elliptical coating in the fixed width is realized.

Figure 14:
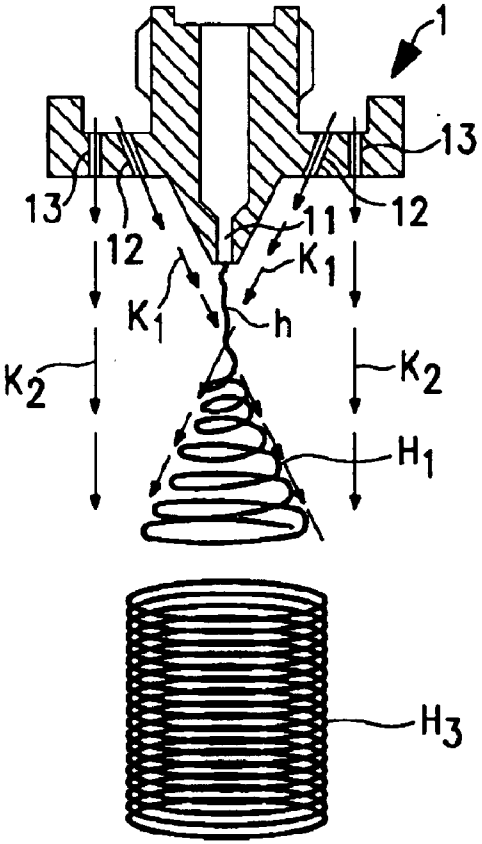
FIG. 14 is an explanatory drawing, showing the action of the first invention of the present Application.

In the case where low viscosity hot melt adhesive is coated, spiral rotating pattern H1 rotates at high velocity by the action of auxiliary pressurized air flow K2 extruded from the second pressurized air hole 13 and consequently overlapping of multiple ovals H3 become dense, as shown "H3" in FIG. 14.

Figure 15:
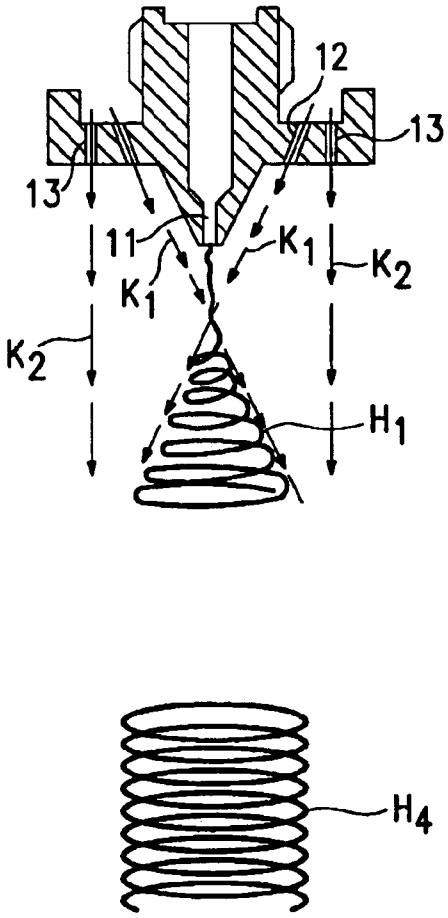
FIG. 15 is an explanatory diagram, similar to FIG. 14, showing the enlarged coating surface.

In the case where the distance between the nozzle tip 1 of the gun unit and the coating surface is enlarged, a pattern width of the spiral rotating pattern H4 is enlarged and a coating area can be enlarged, as shown FIG. 15. Consequently, in the case where a plurality of gun units (nozzles) are used for coating in width direction, the number of gun units (nozzles) to be mounted can be decreased.

Figure 16:
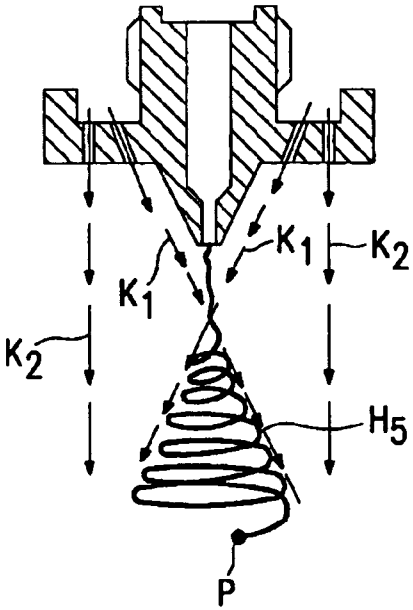
FIG. 16 is an explanatory diagram, similar to FIG. 14, showing a particle p falling within the coating range.
Figure 18:
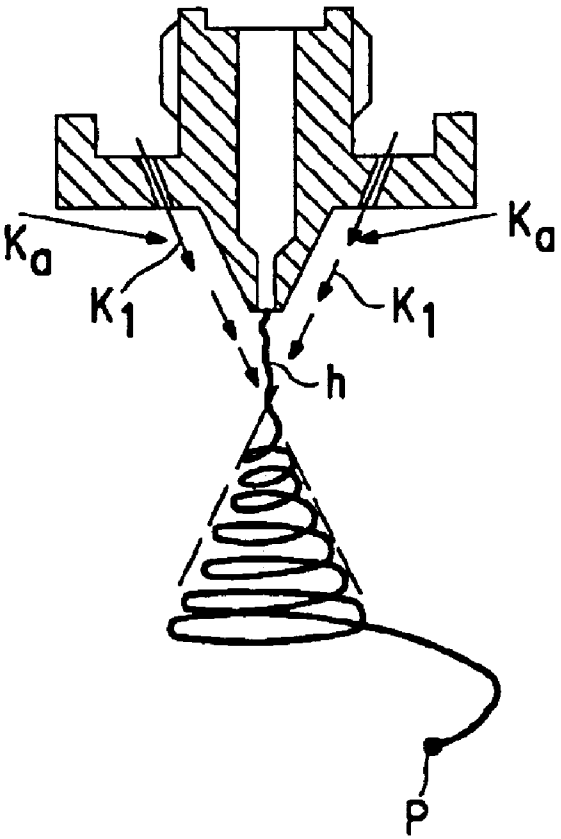
FIG. 18 is an explanatory diagram, corresponding to the action in the prior art shown by FIG. 16, showing a particle p falling outside the coating range and existence of accompanying air Ka.

The size of a particle p (also referred to as a shot, a hook, a particle ball or the like) which is produced at the start of spray coating can be reduced by 30%–80% by the section of the second pressurized air flow (auxiliary pressurized air flow) K2 discharged from the second pressurized air hole 13. As shown by the adhesive fiber spiral rotating pattern H5, a particle p settles within the range of the spiral rotating pattern H5 (refer to FIG. 16). Therefore, such troubles as particles of heated and molten resin settling on a material and making holes in the material, with resultant lowering of merchandize value, and soiling of processing machines by dispersed particles can be prevented.

According to the first invention of the present application, spiral rotation of fiber-like adhesive is accelerated and spiral spraying of high viscosity hot melt resin can be carried out in good condition, by rotating the auxiliary pressurized air flow extruded from a plurality of the second pressurized air holes in the direction concentric with the arrangement of the second pressurized air holes and by causing the rotating auxiliary pressurized air How to act on the spiral rotating pattern of fiber-like adhesive.

The first invention dose not involve the accompany air Ka flowing toward the bottom side of the nozzle tip Even if accompanying air is created, the accompany air Ka is prevented from entering into the spiral rotating pattern H1 of adhesive fiber because the auxiliary pressurized air flow K2 from the second pressurized air hole 13 falls perpendicularly as it is surrounding the outer part of the spiral rotating pattern H1 of adhesive fiber.

In the second invention of the present application, since the pressurized air feeding passage to the first pressurized air flow K1 and to the second pressurized air flow K2 are independent of each other, the running speed of the first pressurized air flow K1 and the running speed of the second pressurized air flow K2 can be determined independently. Also, it is possible to use different gaseous body for the first pressurized air flow K1 and the second pressurized air flow K2, for instance, either one of the first pressurized air flow K1 and the second pressurized air flow K2 adopts the air.

The invention of the present application has the effect of putting the spiral spray of high viscosity hot melt resin to practical use by causing the second pressurized air flow (auxiliary pressurized air flow) from the second pressurized air hole to act to the spiral rotating pattern of adhesive fiber.

The invention of the present application can heighten productivity in spiral spraying of low viscosity hot melt resin by enlarging the coating area by enlarging the diameter of gyration.

The invention of the present application can settle the problem of particles to be generated at the start of coating and at the intermittent coating by making the size of particles smaller, thereby limiting the settling point of particles on a material within the scope of a spiral rotating pattern.

The invention of the present application also can solve the problem of occurrence of accompanying air K2 outside the pressurized air flow (spiral air) K1 in spiral spray coating and dispenses with the trouble of removing impurities stuck to be bottom of the nozzle tip while operation is suspended. Thus, continuous long-term operation can be realized and coating cost is lowered.

INDUSTRIAL APPLICABILITY

As mentioned above, the method of spiral spray coating and apparatus therefore according to the present invention is suitable for automatic and continuous adhesive spray coating on a material being conveyed on a coating line.

What is claimed is:

1. An apparatus for spraying a pattern of adhesive, said apparatus comprising:

a nozzle body having a nozzle tip coupled thereto and wherein:

said nozzle tip comprises:

an adhesive hole for spraying out adhesive provided in a center of said nozzle tip;

a plurality of first holes disposed concentrically with said adhesive hole, said first holes being provided at an angle of rotation relative to said nozzle tip and for having pressurized air applied thereto for causing adhesive sprayed from said adhesive hole to spirally rotate; and a plurality of second holes disposed concentrically with said adhesive hole outside said plurality of said first holes, said second holes for having pressurized air applied thereto for providing an air curtain about said spirally rotating adhesive sprayed from said adhesive hole whereby said spirally rotating adhesive is contained within said air curtain.

2. An apparatus according to claim 1 wherein said nozzle body is coupled to said nozzle tip by a screw fit structure.

3. An apparatus according to claim 2 wherein said pressurized air is commonly applied to said first and second holes.

4. An apparatus according to claim 2 wherein said pressurized air is separately applied to said first and second holes.

5. A method for spirally spraying an adhesive from a nozzle comprising;

spraying out adhesive from an adhesive hole provided in a center of a nozzle tip of said nozzle;

causing said adhesive sprayed from said adhesive hole to spirally rotate by means of a pressurized air flow from a plurality of first holes disposed concentrically with said adhesive hole and at an angle of rotation relative to said nozzle tip; and providing an air curtain of pressurized air about said spirally rotating adhesive sprayed from said adhesive hole from a plurality of second holes disposed concentrically with said adhesive hole outside said plurality of first holes in said nozzle tip;

whereby said spirally rotating adhesive is contained within said air curtain.

* * * * *

UNITED STATES PATENT AND TRADEMARK OFFICE

CERTIFICATE OF CORRECTION

PATENT NO. : 6,745,948 B1
DATED : June 8, 2004
INVENTOR(S) : Shoji Hidaka et al.

It is certified that error appears in the above-identified patent and that said Letters Patent is hereby corrected as shown below:

Title page,
Item [54], Title, change "METHOD AND DEVICE FOR SPIRAL SPRAY COATING" to -- METHOD AND APPARATUS FOR SPIRAL SPRAY COATING --

Signed and Sealed this

Second Day of August, 2005

JON W. DUDAS
*Director of the United States Patent and Trademark Office*